United States Patent [19]

Kirby et al.

[11] 4,444,453

[45] Apr. 24, 1984

[54] ELECTRICAL CONNECTOR

[75] Inventors: Allan B. Kirby, Sidney Center, N.Y.; Geoffrey P. Johnson, Movato, Calif.

[73] Assignee: The Bendix Corporation, Southfield, Mich.

[21] Appl. No.: 308,061

[22] Filed: Oct. 2, 1981

[51] Int. Cl.[3] ..... H01R 17/18

[52] U.S. Cl. ..... 339/177 R; 339/89 C

[58] Field of Search ..... 339/177 R, 177 E, 89 R, 339/89 C, 90 R, 90 C; 174/88 C

[56] References Cited

U.S. PATENT DOCUMENTS

| | | | |
|---|---|---|---|
| 3,336,563 | 8/1967 | Hyslop | 339/61 R |
| 3,373,243 | 3/1968 | Janowiak et al. | 174/88 C |
| 3,723,946 | 3/1973 | Weatherup et al. | 339/89 R |
| 4,053,200 | 10/1977 | Pugner | 339/177 R |
| 4,135,776 | 1/1979 | Ailawadhi et al. | 339/177 R |
| 4,180,301 | 12/1979 | Hutter | 339/90 R |

*Primary Examiner*—Eugene F. Desmond
*Assistant Examiner*—David L. Pirlot
*Attorney, Agent, or Firm*—Raymond J. Eifler; Charles D. Lacina; John R. Benefiel

[57] ABSTRACT

An electrical connector (60) is disclosed of the type to which a coaxial cable (22) having a braided conductor layer (26) is adapted to be clamped to establish electrical and mechanical connections, characterized by a simplified cable clamping means. The clamping means includes an outer contact-clamping body (72) formed with a clamping cone (112) integral with an outer contact portion (68). In preferred embodiments, the contact-clamping body (72) is engagable to be held against rotation by flats (94) formed on the outside diameter of an intermediate section (93) thereof, connector coupling sleeve (62) movable into mating engagement therewith, and to be retracted to allow the coupling sleeve (62) to be rotatable during coupling with a mating connector.

1 Claim, 9 Drawing Figures

Fig-2
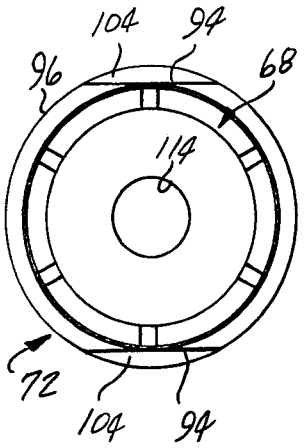
Fig-3
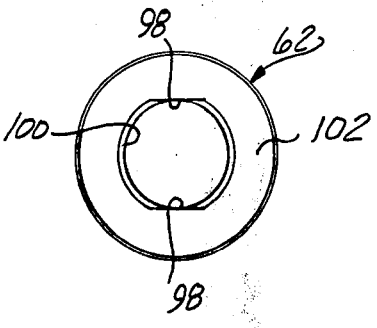
Fig-5
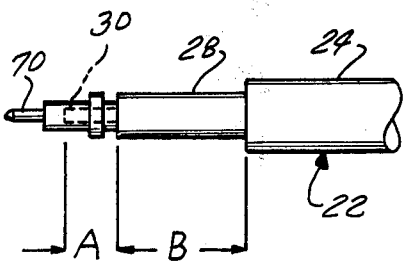
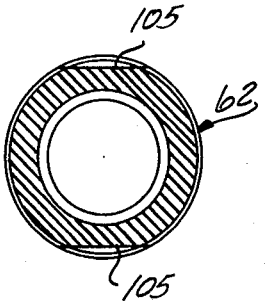
Fig 4

ELECTRICAL CONNECTOR

This invention concerns electrical connector components and more particularly electrical connector components of the type adapted to be mated by means of a coupling sleeve carried by one component and threaded or bayonet connected to the mating connector component; and which is adapted to be secured to a coaxial cable of the type including an outer insulating jacket, an inner braided conductor, and a central insulating core surrounding a central wire conductor. Most typically the central conductor is connected to a central contact and the braided conductor connected to an outer contact, both contacts adapted to mate with contacts carried by the corresponding mating connector.

The coaxial braided conductor in prior art connectors is often clamped to a connector component separate from the body component to provide both an electrical and mechanical connection as opposed to other methods of joining the braided conductor, in order to simplify the assembly of the connector component to the coaxial cable. See for example U.S. Pat. No. 3,373,243 issued on Mar. 12, 1968 entitled "Electrical Multiconductor Cable Connecting Assembly."

A typical prior art clamping arrangement includes a clamping cone which carries an insulating spacer into which is mounted a central contact. The insulating spacer is provided with an inner bore sized to receive the coaxial cable insulating core, while the central contact is received in a second bore in the insulating spacer such that the central conductor of the cable may be soldered or crimped thereto at assembly. Alternatively, the insulating spacer may act as a point at which the core bottoms.

At assembly, the outer insulating jacket and braided conductor and central insulating core are cut back a predetermined distance from the end of the stripped central conductor and the sharp end of the clamping cone inserted in between the central insulating core and the braided conductor. A clamping nut, previously placed on the coaxial cable, is then slid down into engagement with a internally threaded section of an outer contact body which receives an external thread on the clamping nut. The clamping nut has an internal generally stepped clamping surface for the purpose of creating a clamping area between the nut internal surface and the clamping cone. Other similar non conical clamping arrangements have also been employed.

The outer surface of the internally threaded section of the outer contact body is formed with flats such as to enable holding thereof during wrenching, the nut having similar wrenching flats formed thereon such that the nut may be advanced to securely clamp the braided conductor against the outer surface of the clamping cone.

There is thus established a mechanical and electrical connection therebetween by the engagement of the braided conductor inner surface with the outer surface of the clamping cone. As the clamping nut is advanced, a surface formed on an internal bore of the outer contact body and a mating surface on the forward face of the clamping nut come into engagement to provide an electrical connection to the outer contact.

It will be appreciated that this arrangement will provide a secure mechanical connection in many installations under normal conditions. However, cold flow of certain jacket materials may cause loosening of the connection. Also, the arrangement is relatively complex, since it requires an internally threaded contact body extended to the rear of the coupling sleeve, the separate clamping cone and insulating spacer, as well as the clamping nut.

In addition, the electrical connection relies on establishing good contact between the mating conical surfaces on the contact body and nut. This arrangement has proven to be sometimes troublesome, if for any reason good contact is not established at assembly of the connector due to the presence of foreign material, improper assembly, or thereafter loosens due to thermal cycling, cold flow of the jacket material or other reasons.

DISCLOSURE OF THE INVENTION

The present invention provides an improved clamping arrangement for electrical connectors of the type described utilizing a coaxial cable clamp for the purpose of establishing electrical and mechanical connections which has the advantage of being much simplified over the prior art approach.

The present invention provides such clamping arrangement which has the advantage of improved reliability of the electrical connection over such prior art arrangement.

The invention comprises an electrical connector with simplified clamping means for connection to coaxial cable, including an integral outer contact-clamping body, having one end formed with the outer contact and received within a coupling sleeve and the other end formed with a clamping cone surface adapted to be threadably received within a clamping nut. The clamping cone surface extends opposite to a clamping surface formed on the interior of the clamping nut for the purpose of receiving the braided conductor layer of a coaxial cable into clamping engagement.

In the preferred embodiment, the integral contact-clamping body is formed with one or more wrenching features disclosed as a series of flats which are adapted to be engaged by the coupling sleeve upon proper axial positioning of the coupling sleeve. Repositioning of the coupling sleeve out of engagement with flats on the contact-clamping body enables the coupling sleeve to be rotated for connection with a mating connector.

In another embodiment, the integral outer contact-clamping body is formed with wrenching flats at its forward end thereof about the exterior of the outer contact portion to enable holding of the integral outer contact-clamping body during advancing of the clamping nut.

In each embodiment, the integral outer contact-clamping body is formed with an interior bore adapted to receive the insulator core and central element as well as the central contact for assembly of the central conductor and the central contact into a plug or jack connector.

A major advantage results from the integral construction of the contact and clamping body ensuring optimal reliability of electrical connection to the braided conductor layer. At the same time this construction greatly simplifies the connector itself by reducing the number of joints to a single joint to simplify its assembly to the coaxial cable as well as its manufacture and lower its cost.

DETAILED DESCRIPTION OF THE DRAWINGS

FIG. 2 is an end-wise view of the integral outer contact-clamping body.

FIG. 3 is an end-wise view of the coupling sleeve from the right side as positioned in FIG. 2.

FIG. 4 is a view of a section taken through wrenching flats on the coupling sleeve.

FIG. 5 is a fragmentary view of the coaxial cable end installed on a pin contact indicating the dimensions to which the insulator jacket, braided conductor layer, and core insulator are removed for installation.

It should be noted at the outset that the concept of the present invention is applicable to plug or jack connectors, and that the central contact may be male (pin) or female (socket), and the particular embodiment shown is for illustrative purposes only.

Figure 1:
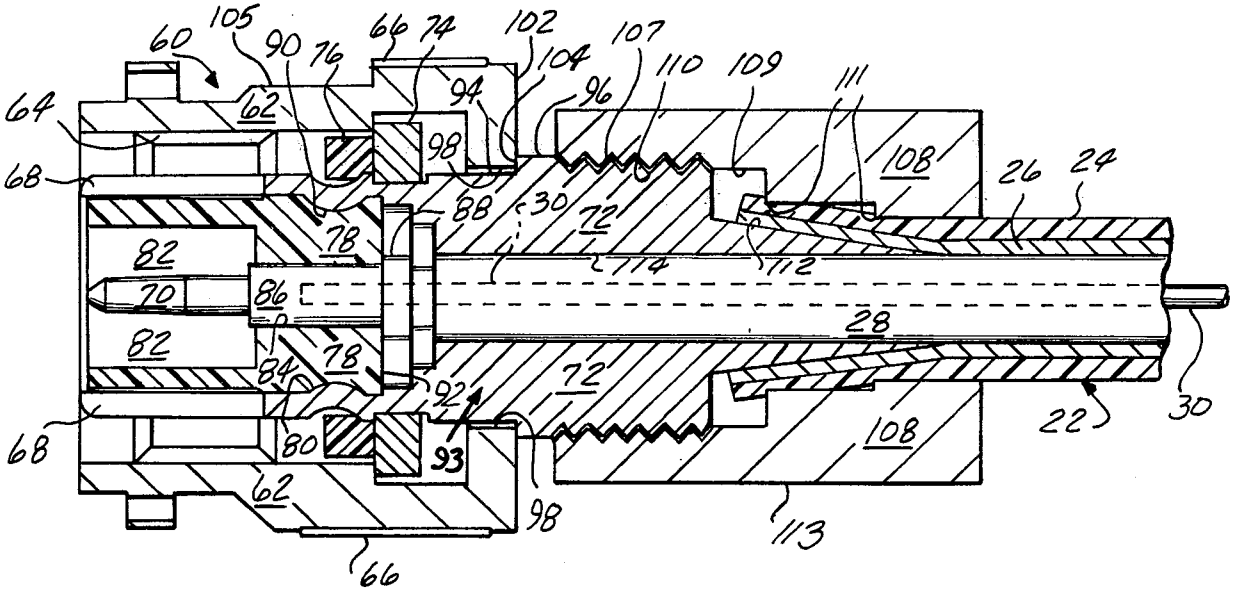
FIG. 1 is a longitudinal sectional view of a plug connector incorporating a cable clamping arrangement according to the present invention.
Figure 1A:
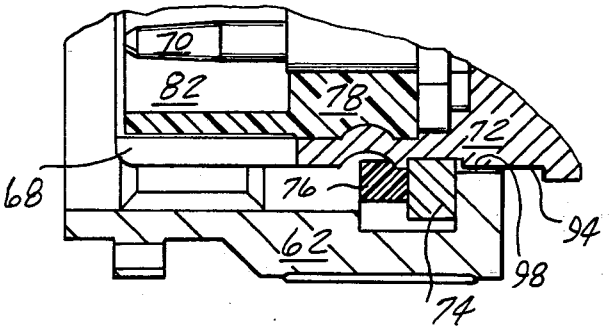
FIG. 1A is a fragmentary view of the plug connector shown in FIG. 1 with a coupling sleeve moved to a release position disengaged from flats on the integral outer contact clamping body.

Referring then to the drawings and particularly FIG. 1, a plug connector 60 is illustrated including an outer coupling sleeve 62 utilized to join the plug connector 60 to a receptacle or jack connector (not shown) by various means as by internal thread 64 adapted to cooperate with an external thread on the receptacle connector (not shown). The outside diameter of the coupling sleeve 62 is formed with a knurling 66 for convenient manipulation. The connector 60 includes a pair of concentric electrical contacts mounted together with the coupling sleeve into a connector assembly. These contacts include an outer contact 68, which may consist of a number of contact fingers arranged annularly as shown in FIG. 2, and an inner pin contact 70 mounted telescopically thereto. The outer contact 68 forms one end of a generally cylindrical conductive contact-clamping body 72 received within the coupling sleeve 62, The coupling sleeve 62 is retained the contact-clamping body 72 by means of a snap ring 74 received in a recess on the exterior of the integral outer contact-clamping body 72. A gasket 76 may also be provided to provide sealing of the joined plug and jack connectors.

Pin contact 70 is provided in a located position by means of a insulator spacer 78 within an interior bore 80 at the front face of the integral contact-clamping body 72 whereat the outer contact 68 is located, the insulator spacer 78 having a clearance bore 82 to receive the corresponding mating portion of the receptacle connector.

In addition, insulator spacer 78 is formed with a smaller diameter bore 84 into which is slidably disposed the seat portion 86 of the contact 70. Formed on the rear or tail section of the pin contact 70 is a shoulder 88 which abuts against rear face 90 of the insulator spacer 78 to provide end-wise or axial location thereof.

The insulator spacer 78 is trapped by an annular indentation or crimp 92 formed into the outer contact 68 of the integral outer contact-clamping body 72 to provide end-wise location of the insulator spacer 78 in the bore 80.

The integral outer contact-clamping body 72 includes a cylindrical intermediate section 93 which is formed with a series of flats 94 that are relieved from an outside diameter 96, to be recessed thereinto. Flats 94 may take the form of a pair of oppositely located flats as shown, or a hexagonal series to enable wrenching.

The series of flats 94 provide a wrenching feature enabling holding of the outer contact-clamping body 72 during clamping of a coaxial cable 22 as will be described hereinafter.

FIG. 3 best illustrates these features. The presence of the flats 94 also creates a locating shoulder 104 to limit the axial movement of the coupling sleeve 62 to locate the same with wrenching features or flats 98 in engagement with the external wrenching features or flats 94.

FIG. 2 best illustrates these features.

The coupling sleeve 62 is configured with an inwardly turned rim 102 having internal flats 98 formed in a bore 100, sized to be received over the outside diameter 96 of the intermediate section 93 of the integral contact-clamping body 72.

Referring again to FIG. 1, the coupling sleeve 62 in this position is enabled to be gripped by means of exterior flats 105 (See FIG. 4) machined into the knurling 66 or by gripping of the knurling 66 itself and thereby enabling the integral outer contact-clamping body 72 to be secured against relative rotation with respect to the coupling sleeve 62, allowing the integral outer contact clamping body 72 to be turned into the cable 22 by rotation of the coupling sleeve 62.

As FIG. 1 shows, the coupling sleeve 62 may be axially retracted to move the flats 98 out of engagement with flats 94 and allowing free rotation thereof in order to enable normal rotation for coupling by threaded engagement with the mating receptacle or jack connector (not shown).

The clamping means includes a clamping nut 108 which has an opening 109 formed with an internal thread 110 threadably received on an exterior thread 107 formed on the outside diameter of the intermediate section 93 of the integral outer contact-clamping body 72 to provide a means for establishing a threaded engagement between the contact-clamping body 72 and the clamping nut 108. The clamping nut opening 109 is is also formed with stepped shoulders located at 111 to define a generally conical clamping surface as in the prior art construction which is brought into registry with an integral rear end section of the contact-clamping body 72 having a generally conically shaped clamping surface 112 located at the opposite end from the outer contact portion 68. A clamping area between shoulders 111 and clamping surface 112 is thus defined, adapted to receive an outer insulating jacket 24 and a braided conductor layer 26 of a coaxial cable 22. The clamping area is sized such as to ensure adequate clamping pressure on the jacket 24 and braided layer 26 upon advance of the clamping nut 108 on the exterior thread 107. Wrenching flats 113 enable wrenching of the clamping nut 108 to carry out clamping as described.

The outer contact-clamping body 72 is also provided with an interior bore 114 which extends through the interior of the intermediate and rear end sections of the outer contact-clamping body 72 and is sized to receive an insulator core 28 in sliding fit therein to install the coaxial cable 22 after as shown in FIG. 5. The outer jacket 24 and and braided conductor layer 26 are removed back to the dimension "A"+"B". The inner core 28 is then cut back to expose a length of central conductor 30 of the dimension "A". The clamping nut 108 has been previously installed over the end of the coaxial cable 22 and pulled back. The conductor 30 is then placed in the interior of the pin contact 70 and crimped or soldered in place. The pin contact 70 is inserted into the bore 114 and advanced bringing the braided conductor layer 26 and jacket layer 24 into position adjacent the sharp end of the clamping cone surface 112. The coupling sleeve 62 is placed in position with flats 98 in engagement with flats 94, so that the integral outer contact-clamping member 72 may be turned and advanced until the shoulder 88 bottoms out against the end face 92 of the insulator spacer 78.

The clamping nut 108 is then slid down and brought into threaded engagement with external threads 107, and rotation commenced in order to provide a secure clamping of the jacket 24 with the braided conductor layer 26 forced tightly against the exterior surface of the clamping surface 112. A spiralling or other gripping feature may be machined into the exterior of the clamping surface 112 to further enhance the contact therebetween.

It can be seen that this provides a much simplified structure over the prior art connector as described in that only single part, i.e., the outer contact-clamping body 72, is provided replacing the separate clamping cone, insulator and other components. At the same time the reliability of the electrical connection from the braided conductor layer 26 is much improved since the electrical connection is directly from the clamping surface 112 to the contact section 68 of the integral outer contact clamping body 72. Also, the installation procedure is expeditious and trouble-free.

Figure 6:
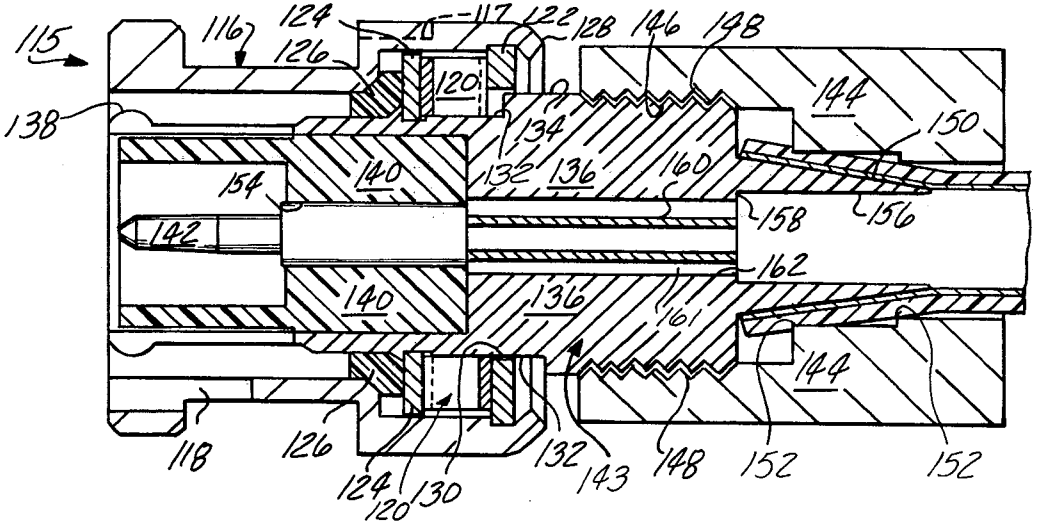
FIG. 6 is a view in partial longitudinal section of a plug connector and alternate arrangement for installation of the pin contact incorporating the clamping arrangement according to the present invention.

Referring to FIG. 6, an application of this invention to a bayonet connected plug connector 115 is illustrated. In this version the outer coupling sleeve 116 having wrenching flats 117 is adapted to be axially advanced and rotated to bring a bayonet slot 118 into secure engagement with a pin carried by a jack connector (not shown). The coupling sleeve 116 is adapted to be axially manipulated against the spring bias exerted by a wave washer 120 secured between a washer 122 and a snap ring 124. A gasket 126 is provided to seal the interior of the connector 115 after coupling, disposed abutting the interior of the coupling sleeve 116 and snap ring 124. The washer 122 is fixed in position by a crimped shoulder 128 so as to be fixed axially and rotatably to the coupling sleeve 116. The washer 122 is formed with an interior bore having flats (or hex) 130 which move into corresponding engagement with flats (or hex) 132 formed on an outside diameter 134 of an outer contact-clamping body 136.

The contact-clamping body 136 includes an outer contact portion 138, as in the previous embodiment, which similarly receives a spacer insulator 140 serving to locate a central pin contact 142 therein. Also, a clamping nut 144 is provided having an interior thread 146 threadedly engaged with an exterior thread 148 formed on an intermediate section 143 of the outer contact-clamping body 136. A generally conical or tapered shape clamping surface 150 on a portion of the contact clamping body 136 integral therewith extends into juxtaposition with a clamping surface area 152 formed in the interior of the clamping nut 144 for clamping of the coaxial cable insulating 24 jacket and braided conductive layer 26. The pin contact 142 is received in a bore 154 of the spacer insulator 140.

The insulator core 28 is adapted to be received into a bore 156 extending within the contact-clamping body 136 and a locating shoulder 158 at the end of bore 156 establishes the lengthwise positioning of the assembly therein. A locator tube 160 extends to a smaller diameter bore 162 serving to locate the central contact 142 upon insertion into the interior of the contact clamping body 136 and spacer insulator 140 assembly. As will be appreciated by those skilled in the art, the thickness of the location tube 160 is selected so that together with the air gap 161 between the bore 162, a constant "electrical section" is maintained to correspond with the cable 22 electrical section.

To carry out connection with a mating component, the coupling sleeve 116 is axially retracted against the influence of the wave washer 120, enabling the rotation necessary for completion of the bayonnet connection. The tube 160 serves to resist axial pressures acting on the contact pin 142 during connection of the plug with the jack.

In making the connection with the coaxial cable 22, this version is employed in similar fashion as in the embodiment shown in FIGS. 1–5 except that the trim lengths are of course varied in conformity with the lengths of the bores 162, 156 and 154.

Figure 7:
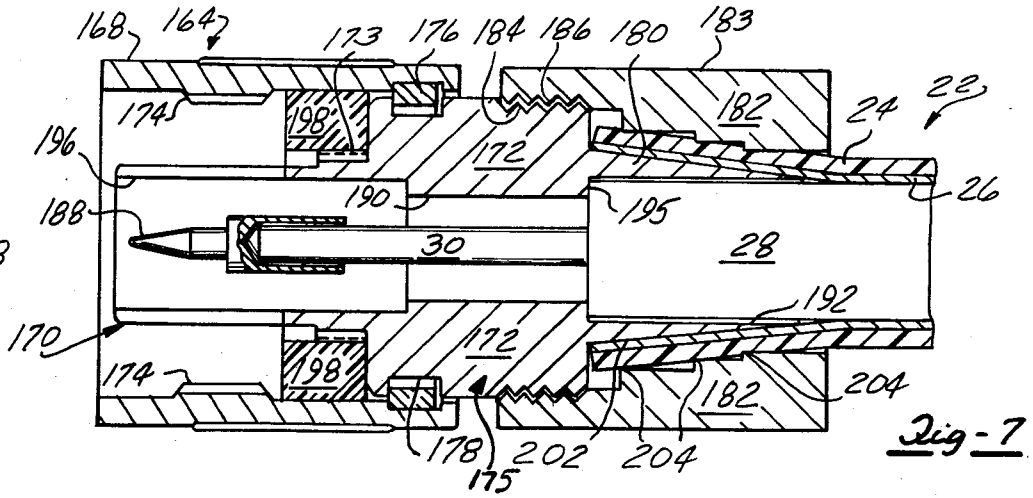
FIG. 7 is a view in longitudinal section of a plug connector incorporating an alternate form of the clamping arrangement according to the present invention.
Figure 8:
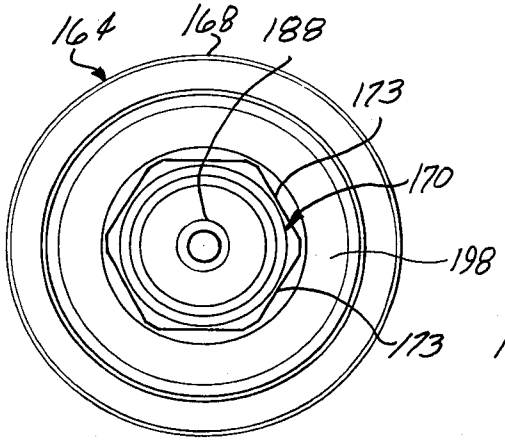
FIG. 8 is an end-wise view of the plug connector shown in FIG. 7.

In FIGS. 7 and 8 there is depicted an alternative construction for a large diameter plug connector 164 which is of sufficiently large diameter to enable engagement with a socket wrench.

Accordingly, in this version, a series of wrenching flats 173 are formed on the exterior of an outer contact-clamping body 172 to the rear of an outer contact 170. A coupling sleeve 168 is shown as having threads 174 for mating with external threads on the corresponding jack (not shown) and axially fixed thereto by means of a snap ring 176 disposed in a recess 178 extending into the exterior outside diameter of the outer contact-clamping body 172.

The outer contact section 170 as in the other versions is integral with an intermediate section 175 and also with a portion at the other end having a clamping cone surface 180 formed thereon. A clamping nut 182 is provided, as in the other versions, which has an internal thread 184 mating with external thread 186 formed on intermediate section 175 of the integral outer contact clamping body 172. The pin contact 188 in this particular plug connector configuration is supported on the central conductor 30 of the coaxial cable 22, received into a stepped bore 190 and 196. Coaxial central insulator core 28 is received in a bore 192 formed in the outer contact clamping body 172 in axial registry with the clamping cone 180.

The shoulder 195 defined by the end of the bore 192 provides end-wise location of the coaxial cable 22 with respect to the plug connector 164.

To install a coaxial cable 22, the outer layers of the coaxial cable 22 are stripped in order to provide an exposed length of the central conductor 30. The pin contact 180 is then crimped or soldered thereto, clamping nut 22 having been previously placed over the end of the cable 22 and retracted away from the end. A coupling sleeve gasket 198 is unassembled from the integral contact-clamping body 172 at this stage to provide access to the hex flats 173.

The clamping nut 182 is configured with an external hexagonal surface 183 for engagement with a suitable wrenching tool.

Accordingly, the hex flats 173 are engaged with a socket wrench (not shown) and the coaxial cable 22 inserted onto the outer contact clamping body 172 with the sharp end of the clamping cone portion 180 inserted between the core insulator 28 and the coaxial braided conductor layer 26. In this version the socket wrench is used to engage the flats 173 to advance the contact-clamping body 172 within the braid layer 26. After seating of the integral outer contact-clamping body 172, with the core 28 against shoulder 195, the clamping nut 182 is advanced until it has bottomed out, clamping the braided conductor 26 and jacket 24 against a conical surface 202 formed on clamping cone 180 and clamping surfaces 204 formed within clamping nut 182.

The coupling sleeve 168 and gasket 198 are then assembled to this connector.

Accordingly, it can be seen that by this arrangement that a greatly simplified connector component structure results, which inherently provides a highly reliable electrical connection between the coaxial braided conductor layer to the corresponding outer contact section. At the same time, the assembly of the connector to the coaxial cable is facilitated in that a secure mechanical and electrical connection can be made with a minimum number of component parts.

Many variations are, of course, possible within the scope of the invention, such as the use of the arrangement with jack connectors with a central socket contact rather than the plug connector with a central pin contact described.

Having described the invention what is claimed is:

1. In combination with an electrical connector of the type having a generally cylindrical outer contact; a central contact; means for telescopically mounting said central contact; means for coupling the connector to another electrical connector including a coupling sleeve mounted to said electrical connector and surrounding the outer contact; and clamping means for mechanically connected said electrical connector to a coaxial cable and for electrically connecting said outer cable to a conductive braided conductor layer of said coaxial cable, the clamping means characterized by:

a generally cylindrical, conductive outer contact-clamping body having a portion thereof forming said outer contact, an integral, cylindrical intermediate section, and an integral end portion having a clamping cone surface formed thereon, said outer contact-clamping body being formed with a wrenching feature, said wrenching feature comprised of flats recessed into said cylindrical intermediate section for a limited distance to thereby form a shoulder;

a clamping nut;

said coupling sleeve carrying an inwardly extending rim portion being formed with an opening having partially circular portions of a diameter sized to fit over said cylindrical intermediate section, said opening also formed with intermediate flats located radially inward from said partially circular portions configured to mate with said flats formed on said cylindrical intermediate section; said coupling sleeve movable on said clamping body to allow movement of said rim over said clamping body flats and against said shoulder to thereby locate said flats on said coupling sleeve rim opening in engagement with said flats on said clamping body; and to allow movement of said rim to a position away from said clamping body flats, said opening allowing rotation of said coupling sleeve on said clamping body in said position; said coupling sleeve formed with wrenching features to enable wrenching of said clamping body by said coupling sleeve;

means for enabling a threadable engagement between said clamping nut and said intermediate section of said contact-clamping body;

said clamping nut having an internal, generally conical clamping surface corresponding to and received over said clamping surface and adapted to be drawn theretowards by said threadable engagement between said clamping nut and said contact-clamping body, said clamping nut being formed with wrenching flats, whereby said coaxial cable braided conductor layer may be clamped between said clamping surfaces to establish said mechanical and electrical connection.

* * * * *